US005904989A

United States Patent [19]

Hänggi et al.

[11] Patent Number: 5,904,989

[45] **Date of Patent: *May 18, 1999**

[54] ALUMINUM SURFACE WITH INTERFERENCE COLORS

[75] Inventors: Paul Hänggi, Neuhausen; Walter Hotz, Beringen; Roman Fuchs, Schaffhausen; Volkmar Gillich, Neuhausen, all of Switzerland

[73] Assignee: Alusuisse Technology & Management Ltd., Switzerland

[ * ] Notice: This patent is subject to a terminal disclaimer.

[21] Appl. No.: 08/832,295

[22] Filed: Apr. 3, 1997

[30] Foreign Application Priority Data

Apr. 18, 1996 [EP] European Pat. Off. ..... 96810245

[51] Int. Cl.[6] ..... B32B 15/04

[52] U.S. Cl. ..... 428/457; 428/469; 428/472.2; 428/699; 428/702

[58] Field of Search ..... 428/457, 469, 428/472.2, 615, 650, 654, 688, 689, 699, 702

[56] References Cited

U.S. PATENT DOCUMENTS 5,760,981 6/1998 Gillich ..... 359/883

5,779,871 7/1998 Gillich ..... 205/116

FOREIGN PATENT DOCUMENTS 0389274 9/1990 European Pat. Off. .

60-033390 2/1985 Japan .

OTHER PUBLICATIONS

"The Surface Treatment and Finishing of Aluminum and Its Alloys" By Wernick & Pinner, vol. 1, 1972, pp. 457–460.

*Primary Examiner*—Elizabeth Evans

*Attorney, Agent, or Firm*—Bachman & LaPointe, P.C.

[57] ABSTRACT

Interference layer which acts as a coloring surface layer on aluminum items, said layer containing an aluminum oxide layer and, deposited on this, a partially transparent layer. The aluminum oxide layer is a transparent, pore-free barrier layer produced by anodizing, of predetermined thickness d corresponding to the desired surface color of the interference layer; the thickness d of the barrier layer lies between 20 and 900 nm, and the partially transparent layer exhibits a wavelength dependent transmission $\tau(\lambda)$ which is greater than 0.01 and smaller than 1. The side of the partially transparent layer facing away from the barrier layer is preferably protected from mechanical and chemical effects by an additional, transparent protective layer.

23 Claims, No Drawings

ALUMINUM SURFACE WITH INTERFERENCE COLORS

BACKGROUND OF THE INVENTION

The present invention relates to an interference layer which acts as a coloring surface layer on aluminum items, said layer containing an aluminum oxide layer and, deposited on this, a partially transparent layer. The invention relates further to a process for manufacturing the interference layer according to the invention.

Interference layers which eliminate certain wavelengths of incident light by interference are known in optical applications as so called filters. Such filters are normally produced by depositing a high purity, thin metal layer on glass, subsequently depositing a dielectric layer and a further semi-transparent metal layer. The individual layers are normally deposited by PVD (physical vapor deposition) methods such as sputtering or vapour deposition.

The high purity, thin metal layer is normally of aluminum. The dielectric layers are normally layers of $Al_2O_3$ or $SiO_2$. Because of their small thickness, it is generally not possible to anodize PVD Al layers. Consequently, the dielectric layers are usually PDV-$Al_2O_3$ or PDV-$SiO_2$ layers. Depositing PDV-$Al_2O_3$ or PDV-$SiO_2$ layers is however expensive. Also, some dielectric layers deposited on aluminum surfaces by PVD methods do not adhere well. Metals such as high purity aluminum are normally employed for the semi-transparent layers.

A dielectric layer may be produced on an aluminum surface using known dc methods i.e. anodic oxidation of the aluminum surface using direct current and a sulphuric acid electrolyte. The resultant protective layer, however, exhibits a high degree of porosity due to the method employed. In order to produce surface layers with uniformity in color over large areas, it is necessary to achieve a constant thickness of interference layer over such areas. Using the dc method, however, it is difficult to produce dielectric layers of constant thickness over large areas.

The oxide layers produced in sulphuric acid are colorless and transparent only with high purity aluminum and AlMg or AlMgSi alloys based on high purity aluminum (Al≧99.85 wt. %). With less pure materials, such as e.g. Al 99.85, Al 99.8 or Al 99.5, alloy constituents such as e.g. Fe or Si rich intermetallic phases may become incorporated in the oxide layer and lead to uncontrolled absorption and/or scattering of light and therefore to layers that are to a greater or lesser extent cloudy, or to layers with coloring which is uncontrollable.

SUMMARY OF THE INVENTION

The object of the present invention is to provide an interference layer which acts as a coloring surface layer on aluminum items, is cost favorable to produce, avoids the above mentioned disadvantages and enables aluminum to be colored in a color-fast manner, or a layer which may be employed as a selective reflecting surface.

That objective is achieved by way of the invention in that the aluminum oxide layer is a transparent, pore-free barrier layer produced by anodizing, of predetermined thickness d corresponding to the desired surface color of the interference layer, the thickness d of the barrier layer lying between 20 and 900 nm (nanometer), and the partially transparent layer exhibiting a wavelength dependent transmission $\tau(\lambda)$ which is greater than 0.01 and smaller than 1.

DETAILED DESCRIPTION OF PREFERRED EMBODIMENTS

The interference layers according to the invention may be formed e.g. on surfaces of parts, strips, sheets or foils of aluminum and on aluminum surface layers on parts made of composites, in particular aluminum outer layers on laminate panels or on any material that has a layer of aluminum deposited on it—e.g. electrolytically deposited aluminum layer.

By aluminum in the present text is meant aluminum of all grades of purity and all aluminum alloys. In particular the term aluminum includes all rolling, wrought, cast, forging and extrusion alloys of aluminum. The surface of material to be provided with an interference layer according to the invention is preferably pure aluminum with a purity of 98.3 wt. % Al or higher, or aluminum alloys made from this aluminum and containing at least one of the following elements: Si, Mg, Cu, Zn or Fe. Also preferred are aluminum surfaces of high purity aluminum alloys with a purity level of 99.99 wt. % Al or higher, e.g. clad material or such having of a purity level of 99.5 to 99.99 wt. % Al.

The aluminum surfaces may exhibit any desired shape and may, if desired, be structured. In the case of rolled aluminum surfaces these may be processed using high gloss or designer rolls. A preferred application for structured aluminum surfaces is e.g. for daytime lighting purposes, for example for decorative lighting, mirrors or decorative surfaces on ceiling or wall elements, or for applications in vehicle manufacture, for example for decorative parts or closures. Used in such cases are especially structured surfaces having structure sizes of usefully 1 nm to 1 mm and preferably from 50 nm to 100 $\mu$m.

Essential to the invention is in particular that the barrier layer is produced in a controlled manner in keeping with the desired color effect. In order to achieve the best possible color fastness in the interference layer, the barrier layer must also be pore-free. This prevents poorly controllable diffuse scattering of light and therefore non-uniform color development. By the term pore-free is, however, not meant absolute freedom of porosity, but rather that the barrier layer of the interference layer according to the invention is essentially pore-free. It is important that the oxide layer produced by anodizing does not exhibit any porosity as a result of the process. By process-inherent porosity is to be understood e.g. the use of an electrolyte which dissolves the aluminum oxide layer. In the present invention the pore-free barrier layer preferably exhibits a porosity of less than 1% and in particular less than 0.5%.

The dielectric constant $\epsilon$ of the barrier layer depends, amongst other factors, on the process parameters used in the production of the barrier layer viz., during the anodic oxidation. The dielectric constant $\epsilon$ of the barrier layer at a temperature of 20° C. usefully lies at a value of 6 to 10.5, preferably 8 to 10.

The color of an aluminum surface with an interference layer according to the invention depends e.g. on the characteristics of the aluminum surface, on the angle at which the light strikes the surface of the interference layer, the angle of viewing, the thickness of the barrier layer, the composition and the thickness of the partially transparent layer and on the transmission $\tau(\lambda)$ of the partially transparent layer. The wavelength dependent transmission $\tau(\lambda)$ is defined in the present text as the quotient $\tau(\lambda)=I/I_0$, where $I_0$ represents the intensity of light of wavelength λ falling on the surface of the transparent layer and I represents the intensity of light emerging from the partially transparent layer. In a preferred version the interference layer according to the invention exhibits a transmission $\tau(\lambda)$ of 0.3 to 0.7.

With regard to the properties required, the thickness of the barrier layer of interference layers according to the invention lie preferably between 30 and 800 nm, in particular between 35 and 500 nm.

The barrier layers of the interference layers may, over the whole interference layer surface, exhibit a local difference in layer thickness, so that e.g. optical color pattern are obtained on the surface of the interference layer. The area of individual color pattern i.e. partial areas of interference layer surface with the same thickness of barrier layer, may range from the sub-micron scale to areas which are large i.e. with respect to the whole interference layer surface.

In principle all reflecting materials are suitable as partially transparent layer materials preferred are commercially available metals of all purities, in particular Ag, Al, Au, Cr, Cu, Nb, Pt, Pd, Rh, Ta, Ti or metal alloys containing at least one of these elements.

The coating of the barrier layers with the partially transparent layer may be effected e.g. by physical methods such as vapor deposition or sputtering, by chemical methods such as CVD (chemical vapor deposition), or by direct chemical precipitation, or by electrochemical methods.

The partially transparent layer may be deposited over the whole of the barrier layer or over only parts of the interference layer surface. For example the parts deposited may form a lattice like network. In the case of the partially transparent layers concerning only specific parts of the interference layer surface, sub-micron structures are preferred.

The partially transparent layer may exhibit a uniform layer thickness or a structured layer i.e. one exhibiting locally different thickness over the partially transparent layer. In the latter case e.g. color patterns may be created also with a uniformly thick barrier layer.

The thickness of partially transparent layer is usefully, over the whole interference layer surface, 0.5 to 100 nm, preferably 1 to 80 nm and in particular 2 to 30 nm.

The partially transparent layer may also be a sol-gel layer preferably having a thickness of 0.5 to 250 μm, in particular 0.5 to 150 μm with reflecting particles incorporated in it, the dimensions of the reflecting particles preferably being in the micron or sub-micron range, in particular in the sub-micron range. Particularly suitable as reflecting particles are metal particles, especially such made of Ag, Al, Au, Cr, Cu, Nb, Ni, Pt, Pd, Rh, Ta, Ti, or metal alloys containing at least one of these elements the reflecting particles may be distributed uniformly in the sol-gel layer or essentially all of them may lie in a plane parallel to the surface of the barrier layer. In a preferred version the partially transparent sol-gel layer, especially when this exhibits an essentially uniform distribution of reflecting particles, exhibits a local difference in layer thickness. This way it is possible to create interference layers with optical color patterns. The local difference in thickness of the partially transparent sol-gel layer may be effected e.g. by embossed rolling, if desired after carrying out a heat treatment in which the sol-gel layer is at least partially polymerized or cured.

In order to protect the interference layers better from adverse mechanical and chemical effects, in a preferred further development a transparent protective layer is provided on the partially transparent layer on the side facing away from the barrier layer. The protective layer may be any kind of transparent layer which offers mechanical and/or chemical protection to the partially transparent layer. For example the transparent layer is a coating, oxide or sol-gel. By a coating here is understood a colorless, transparent, organic protective layer, Preferred oxide layers are layers of $SiO_2$, $Al_2O_3$, $TiO_2$ or $CeO_2$. Layers designated in the present text as sol-gel layers are layers formed using a sol-gel process.

The thickness of such a transparent protective layer is e.g. 0.5 to 250 μm, usefully 1 to 200 μm and preferably 1 to 200 μm. The transparent protective layer may e.g. be applied as the outermost layer on the interference layer in order to protect it from weathering or from fluids that may promote corrosion (acid rain, bird droppings etc.)

The Sol-gel layers are glassy in character, e.g. polymerization products from organically substituted alkoxysiloxanes having the general formula;

$$Y_nSi(OR)_{4-n}$$

where Y is e.g. a non hydrolizable monovalent organic group and R is e.g. an alkyl, aryl, alkaryl or aralkyl group and n is a natural number from 0 to 3. If n is equal to 1 or 2, R may be a $C_1$–$C_4$ alkyl group. Y may be a phenyl group, n equal to 1 and R a methyl group.

In another version the sol-gel layer may a polymerisation product of organically substituted alkoxy-compounds having the general formula:

$$X_nAR_{4-n}$$

where A represents Si, Ti, Zr or Al, X represents HO—, alkyl-O— or Cl—, R represents phenyl, alkyl, alkenyl, vinylester or epoxyether and n the number 1, 2 or 3. Examples of phenyl are unsubstituted phenyl, or moon, DI or trio-substituted $C_1$–$C_9$-alkyl-substituted phenyl, for alkyl, equally methyl, ethyl, propyl, iso-propyl, n-butyl, pentyl etc., for alkenyl-$CH{=}CH_2$, allyl, 2-methylallyl, 2-butenyl etc., for vinylester $—(CH_2)_3—O—C(=O)—C(—CH_3){=}CH_2$ and for epoxy-ether $—(CH_2)_3—O—CH_2—CH(—O—)CH_2$.

The sol-gel layers are, to advantage, deposited directly or indirectly on the interference layer using a sol-gel process. For that purpose e.g. alkoxides and halogensilanes are mixed and, in the presence of water and suitable catalysts, hydrolised and condensed. After remov-ing the water and the solvent, a sol forms and may be deposited on the interference layer by immersion, centrifugal means, spraying etc., whereby the sol transforms into a gel film e.g. under the influence of temperature and/or radiation. As a rule silanes are employed to form the sol; it is also possible partially to replace the silanes by compounds which contain titanium, zirconium or aluminum instead of silicon. This enables the hardness, density and the refractive index of the sol-gel layer to be varied. The hardness of the sol-gel layer may also be controlled by employing different silanes e.g. by forming an inorganic network to control the hardness and thermal stability, or by employing an organic network to control the elasticity. A sol-gel layer which may be categorised between the inorganic and organic polymers can be deposited on the interference layers via the sol-gel process by hydrolysis and condensation of Alkoxides, mainly those of silicon, aluminum, titanium and zirconium. By means of the process an inorganic network is formed and additionally, via appropriately derivatised silicic acid-esters, it is possible to incorporate organic groups which may be employed for functionalising and for forming defined organic polymer systems. Further, the sol-gel film may be deposited by electro-immersion coating after the principle of catephoretic precipitation of an amine and organically modified ceramic The interference layers according to the invention are suitable for technical lighting purposes, e.g. for producing surfaces with intensive colors and/or colors that depend on the angle of illumination and/or viewing e.g. for decorative lights, mirrors or decorative surfaces on ceiling or wall elements. In addition, appropriate interference layers may be employed on the surfaces of items from daily life to prevent forgery e.g. on packaging or containers. Further, such interference layers are preferred for use on automobile parts, in particular car body parts, extrusions or for facade elements for the building industry or for items for interior design purposes.

The present invention relates also to a process for manufacturing the previously described interference layer as a coloring layer on an aluminum item.

That objective is achieved by way of the invention in that the surface of the aluminum item is oxidized electrolytically in an electrolyte that does not redisolve aluminum oxide and that the desired thickness d of the resultant oxide layer, measured in nm, is obtained by choosing a constant electrolyte voltage U in volts according to the relationship $$d/1.6 \leqq U \leqq d/1.1$$

and the thus formed aluminum oxide layer is provided with a partially transparent layer on its free surface.

The production of interference layers according to the invention requires a clean aluminum surface i.e. normally, prior to the process according to the invention, the aluminum surface which is to be oxidized electrolytically must be subjected to a surface treatment, a so called pre-treatment.

The aluminum surfaces usually exhibit a naturally occurring oxide layer which, frequently because of their previous history etc. is contaminated by foreign substances. Such foreign substances may for example be residual rolling lubricant, oils for protection during transportation, corrosion products or pressed in foreign substances and the like. In order to remove such foreign substances, the aluminum surfaces are normally pre-treated chemically with a cleaning agent that produces some degree of attack by etching. Suitable for this purpose, apart from aqueous acidic degreasing agents, are in particular alkaline degreasing agents based on polyphosphate and borate. A cleaning action with moderate to strong removal of material is achieved by caustic or acidic etching using strongly alkaline or acidic pickling solutions such as e.g. caustic soda or a mixture of nitric acid and hydrofluoric acid. In that cleaning process the natural oxide layer is removed and along with it all the contaminants contained in it. When using strongly attacking alkaline pickling solutions, a pickling deposit often forms and has to be removed by an acidic after-treatment. A surface treatment without removing surface material takes the form of a degreasing treatment and may be performed by using organic solvents or aqueous or alkaline cleaning agents.

Depending on the condition of the surface, it may also be necessary to remove surface material using mechanical means. Such a surface treatment may be performed e.g. by grinding, surface blasting, brushing or polishing, and if desired may be followed by a chemical after-treatment.

In the blank metallic state aluminum surfaces exhibit a very high capacity to reflect light and heat. The smoother the surface, the greater is the directional reflectivity and the brighter the appearance of the surface. The highest degree of brightness is obtained with high purity aluminum and special alloys such as e.g. AlMg or AlMgSi alloys.

A highly reflective surface is obtained e.g. by polishing, milling, by rolling with highly polished rolls in the final pass, by chemical or electrolytic polishing, or by a combination of the above mentioned surface treatment methods. The polishing may be performed using cloth wheels with soft cloth. When polishing with rolls it is possible to introduce a given structure to the surface of the aluminum using engraved or etched steel rolls or by placing some means exhibiting a given structure between the rolls and the material being rolled. Chemical polishing is performed e.g. using a highly concentrated acid mixture normally at high temperatures of around 100 ° C. Acidic or alkaline electrolytes may be employed for electrolytic brightening; normally acidic electrolytes are preferred.

From the standpoint of technical lighting characteristics, the barrier layers of interference layers according to the invention on the surfaces of aluminum of purity 99.5 to 99.98 wt. % exhibit no significant difference compared to those of the original aluminum surface i.e. after creation of the barrier layer, the condition of the aluminum surfaces remains essentially as it was e.g. after the brightening treatment. It must, however, be taken into account that the purity of the metal in the surface layer can indeed have an influence e.g. on the degree of brightness obtained with an aluminum surface.

In the process according to the invention at least the aluminum surface to be oxidized is provided with predefined surface condition required for the desired color tone or color structure and subsequently placed in an electrically conductive fluid, the electrolyte, and connected up to a dc source as the anode, the negative electrode normally being of stainless steel, graphite, lead or aluminum. The electrolyte is according to the invention selected such that the aluminum oxide formed during the anodizing process does not dissolve i.e. there is no re-solution of the aluminum oxide. During the process hydrogen gas is formed at the cathode and gaseous oxygen at the anode. The oxygen forming at the anode reacts with the aluminum and forms an oxide layer that increases in thickness in the course of the process. As the electrical resistance of the barrier layer increases quickly, the amount of current flowing decreases correspondingly and the growth of the layer comes to a halt.

Producing barrier layers electrolytically by the process according to the invention enables the thickness of the barrier layer to be controlled precisely. The maximum thickness of the aluminum oxide barrier layer achieved by the process according to the invention corresponds approximately in nm to the voltage in volts (V) applied i.e. the maximum thickness of layer obtained is a linear function of the anodizing voltage. The exact value of the maximum layer thickness obtained as a function of the applied direct voltage U, can be determined by a simple trial and lies between 1.1 and 1.6 nm/V, whereby the exact value of layer thickness as a function of the applied voltage depends on the electrolyte employed i.e. its composition and temperature and on the composition of the surface layer on the aluminum item.

The color tone of the interference layer surface may be measured e.g. by means of a spectrometer.

By using a non-redissolving electrolyte the barrier layers are almost pore-free, i.e. any pores resulting e.g. from contaminants in the electrolyte or structural faults in the aluminum surface layer, but only insignificantly due to dissolution of the aluminum oxide in the electrolyte.

Usable as non-redissolving electrolytes in the process according to the invention are e.g. organic or inorganic acids, as a rule diluted with water, having a pH of 2 and more, preferably 3 and more, especially 4 and more and 8.5 and less, preferably 7 and less, especially 5.5 and less. Preferred are electrolytes that function cold i.e. at room temperature. Especially preferred are inorganic or organic acids such as sulphuric or phosphoric acid at low concentration, boric acid, adipinic acid, citric acid or tartaric acid, or mixtures thereof, or solutions of ammonium or sodium salts of organic or inorganic acids., especially the mentioned acids and mixtures thereof. In that connection it has been found that the solutions preferably contain a total concentration of 100 g/l or less, usefully 2 to 70 g/l of ammonium or sodium salts dissolved in the electrolyte. Very highly preferred are solutions of ammonium salts of citric or tartaric acidic or sodium salts of phosphoric acid.

A very highly preferred electrolyte contains 1 to 5 wt. % tartaric acid to which may be added e.g. an appropriate amount of ammonium hydroxide ($NH_4OH$) to adjust the pH to the desired value.

As a rule the electrolytes are aqueous solutions.

The optimum electrolyte temperature for the process according to the invention, which depends on the electrolyte employed, is, however, of lesser importance for the quality of the barrier layers obtained. Temperatures of 15 to 97° C., especially between 18 and 50° C., are employed for the process according to the invention.

By precisely controlling the thickness of the barrier layer using the process according to the invention, for example by means of specially designed, peaked or plate-shaped cathodes, i.e. by controlling the local acting anodizing potential, it is possible to obtain barrier layers with predetermined locally different thicknesses, by means of which it is possible to create interference layer surfaces with predefined color patterns. Thereby, the electrolyzing direct current U applied during the anodic oxidation of the aluminum surface is selected to be locally different, so that after creating the partially transparent layer a structured coloring effect or a color pattern with e.g. intensive colors is obtained. The locally different anodizing potential is preferably achieved by choosing a predetermined shape of cathode.

The process according to the invention is especially suitable for continuous production of interference layers by continuous electrolytic oxidation of the aluminum surface and/or continuous formation of the partially transparent in a continuous production line, preferably in a strip anodizing and coating line.

EXAMPLE 1

An aluminum item of aluminum having a purity level of 99.90 wt. % Al with a highly reflective surface and an aluminum item of aluminum having a purity level of 99.85 wt. % Al with an electrochemically roughened, highly reflective surface are brightened electrolytically and provided with a barrier layer; in the following the electrochemically roughened surface is called the matt shiny surface. By selecting an anodizing voltage in the range 60 to 280 V barrier layers of thicknesses between 78 and 364 nm are prepared. The samples are provided with a partially transparent layer of Au or Pt approximately 10 nm thick. The resultant interference layer surfaces exhibit colors which depend on the characteristics of the aluminum surface, on the angle of viewing and on the thickness of the barrier layer.

Tables 1 an 2 show the results of the micro-color measurements according to DIN 5033 for barrier layers of different thickness formed on highly reflective surfaces and coated with an approx. 10 nm thick partially transparent metal layer; in table 1 the corresponding values for a partially transparent layer of Au are presented and in table 2 the values are for a partially transparent layer of Pt.

The micro-color measurements according to DIN 5033 are carried out with the incident light falling non-directionally onto the interference layer surface.. The angle of observation is inclined at 8° to the normal to the interference layer surface.

In the following tables L*, a* and b* are the color measurement values. L* is the brightness, 0 being absolutely black and 100 absolutely white. a* represents a value on the red-green axis, positive a* values indicating red and negative a* values green colors. b* represents a value of color tone on the yellow-blue axis, positive b* values indicating yellow and negative b* values blue colors. The position of a color tone in the a* b* planes provides information therefore about the color and its intensity.

The additional details of color in the following tables refer to the colors seen at a viewing angle of 0 and 70° to the normals of the interference layer surfaces.

TABLE 1

| Anodizing voltage | Barrier layer thickness | Color (acc. to RAL) | | Measured Micro-colour Values | | |
|---|---|---|---|---|---|---|
| (V) | (nm) | 0° | 70° | L* | a* | b* |
| 60 | 78 | gold-yellow | cadmium yellow | 62.0 | 24.8 | 49.9 |
| 80 | 104 | heather-violet | beige brown | 53.9 | 32.7 | 46.3 |
| 100 | 130 | bright blue[1)] | red-lilac | 77.2 | −31.0 | 23.4 |
| 180 | 234 | beige red | cadmium yellow | 72.0 | 32.8 | 13.3 |
| 200 | 260 | heather-violet | honey yellow | 65.1 | 55.9 | −32.4 |
| 220 | 286 | blue-lilac | blue-lilac | 66.3 | 14.7 | 30.5 |
| 240 | 312 | emerald green | heather violet | 77.5 | −57.1 | 17.7 |

TABLE 1-continued

| Anodizing voltage | Barrier layer thickness | Color (acc. to RAL) | | Measured Micro-colour Values | | |
|---|---|---|---|---|---|---|
| (V) | (nm) | 0° | 70° | L* | a* | b* |
| 260 | 338 | light green | blue-lilac | 82.8 | −44.3 | 61.4 |
| 280 | 364 | ochre yellow | emerald green | 81.9 | 9.1 | 28.4 |

[1)]in German = Lichtblau

TABLE 2

| Anodizing voltage | Barrier layer thickness | Color (acc. to RAL) | | Measured Micro-color Values | | |
|---|---|---|---|---|---|---|
| (V) | (nm) | 0° | 70° | L* | a* | b* |
| 60 | 78 | green-brown | silver-grey | 61.1 | 1.1 | 11.5 |
| 80 | 104 | blue-lilac | basalt grey | 60.2 | 11.3 | −17.1 |
| 100 | 130 | bright blue[1)] | marine blue | 68.4 | −6.6 | −35.7 |
| 180 | 234 | corn-yellow | brown beige | 59.4 | 21.0 | 2.7 |
| 200 | 260 | red-lilac | pale brown | 56.3 | 34.0 | −38.6 |
| 220 | 286 | violet-blue | violet-blue | 56.9 | 12.8 | −48.1 |
| 240 | 312 | patina green | blue-lilac | 71.8 | −51.6 | 0.4 |
| 260 | 338 | grass green | water blue | 79.1 | −43.0 | 32.4 |
| 280 | 364 | saffron yellow | May green | 75.2 | 17.9 | 24.6 |

[1)]German = Lichtblau

Tables 3 and 4 show the results of micro-color measurements on matt-shiny surfaces acc. to DIN 5033 for various barrier layer thicknesses provided with a 10 nm thick partially transparent metal layer, the values in table 3 referring to the values for a partially transparent layer of Au and table 4 the values for a partially transparent layer of Pt.

A comparison of the values obtained in tables 1 and 2 with those in tables 3 and 4 shows clearly the influence of the surface characteristics of the surface layer on the aluminum item i.e. the structure of the surface layer on the aluminum item contributes to determining the color.

TABLE 3

| Anodizing voltage | Barrier layer thickness | Color (acc. to RAL) | | Measured Micro-color Values | | |
|---|---|---|---|---|---|---|
| (V) | (nm) | 0° | 70° | L* | a* | b* |
| 60 | 104 | heather violet | beige-brown | 57.8 | 40.5 | −26.1 |
| 80 | 130 | bright blue[1)] | red-lilac | 77.3 | −25.9 | −31.5 |
| 100 | 208 | sulphur yellow | cadmium-yellow | 91.3 | −7.3 | 70.6 |
| 180 | 234 | gold-yellow | cadmium yellow | 81.3 | 16.9 | 55.8 |
| 200 | 260 | heather violet | honey yellow | 70.7 | 53.2 | −22.3 |
| 220 | 286 | blue-lilac | blue-lilac | 70.5 | 15.1 | −32.7 |
| 240 | 312 | turquoise-blue | heather violet | 73.7 | −23.1 | −12.8 |
| 260 | 338 | light green | blue-lilac | 82.1 | −55.9 | 34.7 |
| 280 | 364 | cadmium-yellow | yellow green | 86.0 | 12.6 | 59.0 |

[1)]German = Lichtblau

TABLE 4

| Anodizing voltage | Barrier layer thickness | Color (acc. to RAL) | | Measured Micro-color Values | | |
|---|---|---|---|---|---|---|
| (V) | (nm) | 0° | 70° | L* | a* | b* |
| 60 | 104 | beige-brown | moss green | 55.0 | 13.2 | −8.5 |
| 80 | 130 | brilliant blue | red-lilac | 69.0 | −1.8 | −43.8 |
| 100 | 208 | saffron yellow | lemon-yellow | 84.7 | 7.3 | 39.8 |
| 180 | 234 | corn-yellow | brown-beige | 75.9 | 8.2 | 22.6 |
| 200 | 260 | light red-lilac | pale brown | 71.6 | 19.9 | −15.9 |
| 220 | 286 | blue-lilac | blue-lilac | 68.9 | 16.3 | −33.1 |
| 240 | 312 | pigeon-blue | blue-lilac | 70.9 | −15.1 | −21.5 |
| 260 | 338 | grass green | water blue | 81.1 | −43.8 | 14.0 |
| 280 | 364 | zinc-yellow | grass green | 84.0 | −6.9 | 39.3 |

Table 5 shows, for selected barrier layer thicknesses. A comparison of the micro-color measurements acc. to DIN 5033 obtained with interference layers with and without partially transparent layer.

TABLE 5

| Barrier layer thickness (mn) | Matt Surface | | | | | | | | |
|---|---|---|---|---|---|---|---|---|---|
| | non vapor-coated | | | Au-vapor-coated | | | Pt-vapor-coated | | |
| | L* | a* | b* | L* | a* | b* | L* | a* | b* |
| 104 | 90.6 | −1.2 | −6.4 | 57.8 | 40.5 | −26.1 | 55.0 | 13.2 | −8.5 |
| 234 | 93.1 | 3.7 | 0.3 | 81.3 | 16.9 | 55.8 | 75.9 | 8.2 | 22.6 |
| 364 | 94.4 | −0.3 | 3.1 | 86.0 | −12.6 | 59.0 | 84.0 | −6.9 | 39.3 |
| 104 | 88.0 | −3.7 | −5.5 | 53.9 | 32.7 | −46.3 | 60.2 | 11.3 | −17.1 |
| 234 | 87.4 | 3.1 | −4.4 | 72.0 | 32.8 | 13.3 | 59.4 | 21.0 | 2.7 |
| 364 | 89.5 | 0.2 | −0.2 | 81.9 | 9.1 | 28.4 | 75.2 | 17.9 | 24.6 |

EXAMPLE 2

An aluminum foil with an electrolytically brightened highly reflective aluminum surface is provided with barrier layers according to the invention with thicknesses of 39–494 nm by selecting an anodizing voltage in the range 30 to 380 V. The barrier layers are then coated with a partially transparent chromium layer of uniform thickness of 1 to 5 nm on all samples. The deposition of the chromium layer is done by sputtering in a strip process, where the strip speed is about 25 m/min.

Table 6 shows the results obtained on the above mentioned interference layers by micro-color measurement acc. to DIN 5033. The remarks concerning micro-color measurement in example 1 are also valid here. The additional color details acc. to RAL in table 6 refer to the visually perceptible colors at a viewing angle of 0° and 80° with reference to the normal to the interference layer.

TABLE 6

| Anodizing voltage (V) | Barrier layer thickness (nm) | Measured Micro-color Values | | | Color (acc. to RAL) | |
|---|---|---|---|---|---|---|
| | | L* | a* | b* | 0° | 80° |
| 30 | 39 | 66 | 3 | 18 | olive-yellow | light ivory |
| 40 | 52 | 50 | 7 | 25 | green-brown | olive-grey |
| 50 | 65 | 38 | 12 | 11 | nut brown | beige |
| 60 | 78 | 30 | 20 | −38 | night blue | pale brown |
| 70 | 91 | 47 | 0 | −45 | gentian-blue | gentian-blue |
| 80 | 104 | 63 | −9 | −39 | sky blue | sky blue |
| 90 | 117 | 70 | −12 | −32 | sky blue | violet-blue |
| 100 | 130 | 84 | −15 | −13 | bright blue[1)] | brilliant blue |
| 110 | 143 | 86 | −15 | −5 | turquoise-blue | brilliant blue |
| 120 | 156 | 89 | −12 | 22 | green-beige | blue-grey |
| 130 | 169 | 88 | −10 | 36 | honey yellow | colourless |
| 140 | 182 | 81 | 1 | 63 | lemon-yellow | light ivory |
| 150 | 195 | 82 | 0 | 62 | lemon-yellow | light ivory |
| 160 | 208 | 70 | 22 | 46 | saffron yellow | ivory |
| 170 | 221 | 57 | 47 | −8 | old pink | sand yellow |
| 180 | 234 | 48 | 61 | −44 | signal violet | gold-yellow |
| 190 | 247 | 45 | 50 | −67 | purple-violet | saffron yellow |
| 200 | 260 | 54 | 1 | −61 | gentian-blue | rose |
| 210 | 273 | 61 | −22 | −50 | gentian-blue | light pink |
| 220 | 286 | 72 | −48 | −20 | water blue | heather violet |
| 230 | 299 | 80 | −52 | 11 | May green | red-lilac |
| 240 | 312 | 84 | −44 | 38 | yellow-green | brilliant blue |
| 250 | 325 | 85 | −32 | 56 | light green | bright[1)] blue |
| 260 | 338 | 83 | −9 | 53 | genista yellow | light brightblue[2)] |
| 270 | 351 | 77 | 27 | 13 | light pink | turquoise-blue |
| 280 | 364 | 73 | 42 | −5 | old pink | May green |
| 290 | 377 | 68 | 57 | −25 | rose | yellow-green |
| 300 | 390 | 62 | 62 | −40 | heather violet | sulphur yellow |
| 310 | 403 | 60 | 56 | −46 | traffic purple | zinc yellow |
| 320 | 416 | 59 | 24 | −41 | signal violet | beige |
| 330 | 429 | 68 | −59 | 1 | water blue | light pink |
| 340 | 442 | 72 | −74 | 17 | mint green | light heather violet |
| 350 | 455 | 75 | −73 | 27 | traffic green | heather violet |
| 360 | 468 | 77 | −60 | 31 | emerald green | dark heather violet |

TABLE 6-continued

| Anodizing voltage | Barrier layer thickness | Measured Micro-color Values | | | Color (acc. to RAL) | |
|---|---|---|---|---|---|---|
| (V) | (nm) | L* | a* | b* | 0° | 80° |
| 370 | 481 | 80 | −30 | 21 | patina green | signal violet |
| 380 | 494 | 78 | 10 | 1 | colourless | red-lilac |

[1] German = Lichtblau
[2] German = Hellichtblau

We claim:

1. Interference layer which comprises an interference layer which acts as a coloring surface layer on aluminum items, said layer containing an aluminum oxide layer and, deposited on this, a partially transparent layer, wherein the aluminum oxide layer is a transparent, pore-free barrier layer produced by anodizing, of predetermined thickness d corresponding to the desired surface color of the interference layer, the thickness d of the barrier layer lying between 20 and 900 nm, and the partially transparent layer exhibiting a wavelength dependent transmission $\tau(\lambda)$ which is greater than 0.01 and smaller than 1.

2. Interference layer according to claim 1, wherein the thickness d of the barrier layer lies between 30 and 800 nm.

3. Interference layer according to claim 2, wherein said thickness of the barrier layer lies between 35 and 500 nm.

4. Interference layer according to claim 1, wherein for the purpose of creating a structured color effect or to produce a colored pattern on the surface of the interference layer, the barrier layer exhibits areas with predetermined different layer thicknesses corresponding to the desired surface color of the interference layer.

5. Interference layer according to claim 1, wherein the partially transparent layer is metal selected from the group consisting of Ag, Al, Au, Cr, Cu, Nb, Ni, Pt, Pd, Rh, Ta, Ti and a metal alloy containing at least one of these mentioned elements.

6. Interference layer according to claim 1, wherein the partially transparent layer exhibits a layer thickness of 0.5 to 100 nm.

7. Interference layer according to claim 6, wherein said layer thickness is 1 to 80 nm.

8. Interference layer according to claim 6, wherein said layer thickness is 2 to 30 nm.

9. Interference layer according to claim 6, wherein, for the purpose of creating a structured color effect or to produce a colored pattern on the surface of the interference layer, the partially transparent layer exhibits areas with predetermined different layer thicknesses corresponding to the desired surface color of the interference layer.

10. Interference layer according to claim 9, wherein, for the purpose of creating optical color patterns, the partially transparent sol-gel layer containing essentially uniformly dispersed reflecting particles exhibits a structure with local differences in layer thickness.

11. Interference layer according to claim 1, wherein the transparent protective layer is covered by at least one of a coating, a sol-gel layer and a thin oxide layer.

12. Interference layer according to claim 11, wherein the thin oxide layer is of at least one of $SiO_2$, $Al_2O_3$ and $TiO_2$.

13. Interference layer according to claim 1, wherein said partially transparent layer is selected from the group consisting of metal and sol-gel layers, and wherein said partially transparent layer is of a predetermined thickness.

14. Interference layer which comprises an interference layer which acts as a coloring surface layer on aluminum items, said layer containing an aluminum oxide layer and, deposited on this, a partially transparent layer, wherein the aluminum oxide layer is a transparent, pore-free barrier layer produced by anodizing, of predetermined thickness d corresponding to the desired surface color of the interference layer, the thickness d of the barrier layer lying between 20 and 900 nm, and the partially transparent layer exhibiting a wavelength dependent transmission $\tau(\lambda)$ which is greater than 0.01 and smaller than 1, and wherein the partially transparent layer is in the form of a lattice-shaped net, wherein the distances between the lines of the lattice-shaped net are in the sub-micron range.

15. Interference layer which comprises an interference layer which acts as a coloring surface layer on aluminum items, said layer containing an aluminum oxide layer and, deposited on this, a partially transparent layer, wherein the aluminum oxide layer is a transparent, pore-free barrier layer produced by anodizing, of predetermined thickness d corresponding to the desired surface color of the interference layer, the thickness d of the barrier layer lying between 20 and 900 nm, and the partially transparent layer exhibiting a wavelength dependent transmission $\tau(\lambda)$ which is greater than 0.01 and smaller than 1, and wherein the partially transparent layer is a sol-gel layer of 0.5 to 250 $\mu$m with reflecting particles embedded therein, where the dimensions of the reflecting particles are in the micron or sub-micron range.

16. Interference layer which comprises an interference layer which acts as a coloring surface layer on aluminum items, said layer containing an aluminum oxide layer and, deposited on this, a partially transparent layer, wherein the aluminum oxide layer is a transparent, pore-free barrier layer produced by anodizing, of predetermined thickness d corresponding to the desired surface color of the interference layer, the thickness d of the barrier layer lying between 20 and 900 nm, and the partially transparent layer exhibiting a wavelength dependent transmission $\tau(\lambda)$ which is greater than 0.01 and smaller than 1, and wherein the side of the partially transparent sol-gel layer containing essentially uniformly dispersed reflecting particles exhibits a structure with local differences in layer thickness.

17. Process which comprises manufacturing an interference layer which acts as a coloring surface layer on aluminum items, said layer containing an aluminum oxide layer and deposited on this, a partially transparent layer, wherein the surface of the aluminum item is oxidized electrolytically in an electrolyte that does not redissolve aluminum oxide and that the desired thickness d of the resultant oxide layer, measured in nm, is obtained by choosing a constant electrolyte voltage U in volts according to the relationship $d/1.6 \leqq U \leqq d/1.1$ and the thus formed aluminum oxide layer is provided with a partially transparent layer on its free surface.

18. Process according to claim 17, wherein, as non-redissolving electrolyte, solutions containing organic or inorganic acids are employed, and the solutions exhibit a pH-value of 2 to 8.5.

19. Process according to claim 18, wherein, the non redissolving electrolyte is a solution of ammonium or sodium salts of organic or inorganic acids or a solution containing ammonium or sodium salts of organic or inorganic salts and the corresponding organic or inorganic acids.

20. Process according to claim 17, wherein at least one of the electrolytic oxidation of the aluminum surface and the provision of the partially transparent layer is performed as a continuous process in a continuous production line.

21. Process according to claim 17, wherein a locally different electrolyzing dc voltage U is applied to the aluminum surface in order to obtain a structured color effect or colored pattern.

22. Process according to claim 17, wherein the aluminum oxide layer is a transparent, pore-free barrier layer produced by anodizing, of predetermined thickness d corresponding to the desired surface color of the interference layer, the thickness d of the barrier layer lying between 20 and 900 nm, and the partially transparent layer exhibiting a wavelength dependent transmission $\tau(\lambda)$ which is greater than 0.01 and smaller than 1.

23. Process according to claim 17, wherein said partially transparent layer is selected from the group consisting of metal and sol-gel layers, and wherein said partially transparent layer is of a predetermined thickness.

* * * * *

UNITED STATES PATENT AND TRADEMARK OFFICE

CERTIFICATE OF CORRECTION

PATENT NO. : 5,904,989

DATED : May 18, 1999

INVENTOR(S) : PAUL HANGGI ET AL.

It is certified that error appears in the above-identified patent and that said Letters Patent is hereby corrected as shown below:

In Column 13, claim 10, line 55, "claim 9" should read --claim 15--.

In Column 13, claim 11, line 61, "claim 1" should read --claim 16--.

In Column 13, claim 11, line 62, "covered by" should be deleted.

Signed and Sealed this

Twenty-sixth Day of October, 1999

*Attest:*

Q. TODD DICKINSON

*Attesting Officer*

*Acting Commissioner of Patents and Trademarks*